US010964996B2

(12) United States Patent
Kim et al.

(10) Patent No.: US 10,964,996 B2
(45) Date of Patent: Mar. 30, 2021

(54) BIDIRECTIONAL COUPLER

(71) Applicant: Murata Manufacturing Co., Ltd., Kyoto (JP)

(72) Inventors: Ryangsu Kim, Kyoto (JP); Katsuya Shimizu, Kyoto (JP); Yasushi Shigeno, Kyoto (JP); Daisuke Tokuda, Kyoto (JP); Mikiko Fukasawa, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 70 days.

(21) Appl. No.: 16/578,740

(22) Filed: Sep. 23, 2019

(65) Prior Publication Data

US 2020/0021003 A1 Jan. 16, 2020

Related U.S. Application Data

(63) Continuation of application No. PCT/JP2018/010963, filed on Mar. 20, 2018.

(30) Foreign Application Priority Data

Mar. 24, 2017 (JP) ..... JP2017-059815

(51) Int. Cl.
*H01P 5/04* (2006.01)
*H01R 13/66* (2006.01)

(52) U.S. Cl.
CPC ..... *H01P 5/04* (2013.01); *H01R 13/6616* (2013.01); *H01R 13/6625* (2013.01); *H01R 13/6633* (2013.01)

(58) Field of Classification Search
CPC ..... H01P 5/04
See application file for complete search history.

(56) References Cited

U.S. PATENT DOCUMENTS 9,647,314 B1 * 5/2017 Nguyen ..... H01P 5/18
9,685,687 B2 * 6/2017 Solomko ..... H01P 5/18
(Continued)

FOREIGN PATENT DOCUMENTS

JP 2006-157095 A 6/2006
JP 2007-194870 A 8/2007
JP 2015-149765 A 8/2015

OTHER PUBLICATIONS

International Search Report for International Application No. PCT/JP2018/010963 dated Jun. 6, 2018.
(Continued)

*Primary Examiner* — Hai L Nguyen
(74) *Attorney, Agent, or Firm* — Pearne & Gordon LLP

(57) ABSTRACT

Bidirectional detection is performed with a suppressed increase in return loss at an output terminal. A bidirectional coupler includes a detection port, a main line connected to a first port and a second port, a sub-line, a termination circuit, a switch circuit that switches each of one end and another end of the sub-line to the termination circuit or the detection port, and a matching network disposed between the switch circuit and the detection port and including at least one of a first variable capacitor, a first variable inductor, or a first variable resistor. In a first mode for detecting a first signal, the switch circuit connects the one end of the sub-line to the detection port, and connects the other end of the sub-line to the termination circuit.

20 Claims, 9 Drawing Sheets

(56) References Cited

U.S. PATENT DOCUMENTS

| | | | | |
|---|---|---|---|---|
| 10,461,393 | B2 * | 10/2019 | Kim | H03H 1/00 |
| 10,714,806 | B2 * | 7/2020 | Ootsuka | H03H 7/38 |
| 2015/0091668 | A1 | 4/2015 | Solomko et al. | |
| 2015/0171897 | A1 | 7/2015 | Premakanthan et al. | |
| 2016/0065167 | A1 | 3/2016 | Granger-Jones et al. | |
| 2016/0172737 | A1 | 6/2016 | Srirattana et al. | |
| 2017/0026020 | A1 | 1/2017 | Solomko et al. | |

OTHER PUBLICATIONS

Written Opinion for International Application No. PCT/JP2018/010963 dated Jun. 6, 2018.

* cited by examiner

BIDIRECTIONAL COUPLER

This is a continuation of International Application No. PCT/JP2018/010963 filed on Mar. 20, 2018 which claims priority from Japanese Patent Application No. 2017-059815 filed on Mar. 24, 2017. The contents of these applications are incorporated herein by reference in their entireties.

BACKGROUND OF THE DISCLOSURE

Field of the Disclosure

The present disclosure relates to a bidirectional coupler.

Description of the Related Art

In wireless communication devices such as mobile phones, detection circuits are used to detect signal levels. For example, Patent Document 1 discloses a bidirectional coupler including a direction-switching switch and capable of detecting signal levels of both a transmission signal outputted to an antenna and a reflected signal from the antenna. In this configuration, adjusting the impedance of a termination circuit in accordance with the direction, frequency band, and so on of the signal to be detected can improve the directivity of the bidirectional coupler.

Patent Document 1: U.S. Patent Application Publication No. 2016/0172737

BRIEF SUMMARY OF THE DISCLOSURE

However, the configuration disclosed in Patent Document 1 does not include a matching network in the preceding stage of an output terminal from which a detection signal is outputted. Accordingly, the adjustment of the impedance of the termination circuit can cause an impedance mismatch at the output terminal from which the detection signal is outputted, and can increase return loss.

Some embodiments of the present disclosure has been made in view of the foregoing situation, and it is an object of some embodiments of the present disclosure to provide a bidirectional coupler capable of bidirectional detection with a suppressed increase in return loss at an output terminal for a detection signal.

A bidirectional coupler according to an aspect of the present disclosure includes a first port to which a first signal is inputted, a second port from which the first signal is outputted, a detection port from which a detection signal of the first signal or a detection signal of a reflected signal of the first signal is outputted, a first main line having one end connected to the first port and another end connected to the second port, a first sub-line electromagnetically coupled to the first main line, the first sub-line having one end corresponding to the one end of the first main line and another end corresponding to the other end of the first main line, at least one termination circuit that connects the one end or the other end of the first sub-line to ground, a switch circuit that connects each of the one end and the other end of the first sub-line to the detection port or the at least one termination circuit, and a matching network disposed between the switch circuit and the detection port, the matching network including at least one of a first variable capacitor, a first variable inductor, or a first variable resistor.

A bidirectional coupler according to an aspect of the present disclosure includes a first port to which a first signal is inputted, a second port from which the first signal is outputted, a third port to which a second signal is inputted, a fourth port from which the second signal is outputted, a detection port from which any one of a detection signal of the first signal, a detection signal of a reflected signal of the first signal, a detection signal of the second signal, or a detection signal of a reflected signal of the second signal is outputted, a first main line having one end connected to the first port and another end connected to the second port, a second main line having one end connected to the third port and another end connected to the fourth port, a first sub-line electromagnetically coupled to the first main line, the first sub-line having one end corresponding to the one end of the first main line and another end corresponding to the other end of the first main line, a second sub-line electromagnetically coupled to the second main line, the second sub-line having one end corresponding to the one end of the second main line and another end corresponding to the other end of the second main line, a first termination circuit that connects the one end or the other end of the first sub-line to ground, a second termination circuit that connects the one end or the other end of the second sub-line to ground, a first switch circuit that connects each of the one end and the other end of the first sub-line to the detection port or the first termination circuit, a second switch circuit that connects each of the one end and the other end of the second sub-line to the detection port or the second termination circuit, and a matching network disposed between the first and second switch circuits and the detection port, the matching network including at least one of a first variable capacitor, a first variable inductor, or a first variable resistor.

A bidirectional coupler according to an aspect of the present disclosure includes a first port to which a first signal is inputted, a second port from which the first signal is outputted, a third port to which a second signal is inputted, a fourth port from which the second signal is outputted, a detection port from which any one of a detection signal of the first signal, a detection signal of a reflected signal of the first signal, a detection signal of the second signal, or a detection signal of a reflected signal of the second signal is outputted, a first main line having one end connected to the first port and another end connected to the second port, a second main line having one end connected to the third port and another end connected to the fourth port, a first sub-line electromagnetically coupled to the first main line, the first sub-line having one end corresponding to the one end of the first main line and another end corresponding to the other end of the first main line, a second sub-line electromagnetically coupled to the second main line, the second sub-line having one end corresponding to the one end of the second main line and another end corresponding to the other end of the second main line, the second sub-line being connected in series with the first sub-line, a termination circuit that connects the one end or the other end of the first sub-line or the one end or the other end of the second sub-line to ground, a switch circuit that connects each of the one end of the first sub-line, the other end of the first sub-line, the one end of the second sub-line, and the other end of the second sub-line to the detection port or the termination circuit, and a matching network disposed between the switch circuit and the detection port, the matching network including at least one of a first variable capacitor, a first variable inductor, or a first variable resistor.

According to some embodiments of the present disclosure, it is possible to provide a bidirectional coupler capable of bidirectional detection with a suppressed increase in return loss at an output terminal for a detection signal.

DETAILED DESCRIPTION OF EXAMPLE EMBODIMENTS OF THE DISCLOSURE

The following describes an embodiment of the present disclosure with reference to the drawings. The same elements are assigned the same numerals and will not be repeatedly described.

Figure 1:
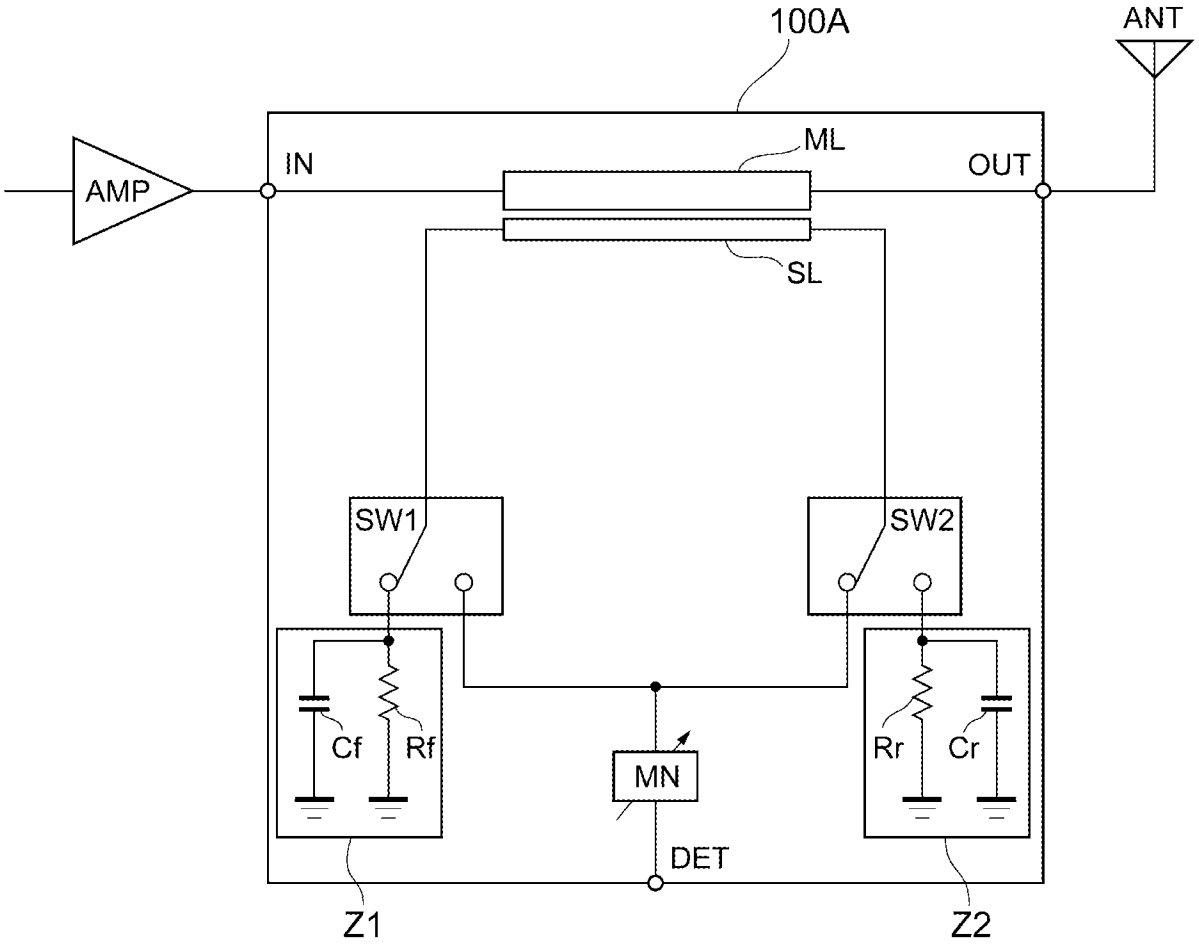
FIG. 1 is a diagram illustrating the configuration of a bidirectional coupler 100A according to an embodiment of the present disclosure.

FIG. 1 is a diagram illustrating the configuration of a bidirectional coupler 100A according to an embodiment of the present disclosure. The bidirectional coupler 100A is capable of, for example, detecting a transmission signal that is transmitted from an amplifier circuit AMP to an antenna ANT (forward). The bidirectional coupler 100A is also capable of detecting a reflected signal from the antenna ANT to the amplifier circuit AMP (reverse).

As illustrated in FIG. 1, the bidirectional coupler 100A includes an input port IN, an output port OUT, a detection port DET, a main line ML, a sub-line SL, switches SW1 and SW2, termination circuits Z1 and Z2, and a matching network MN.

The main line ML (first main line) has one end connected to the input port IN (first port) and another end connected to the output port OUT (second port). A transmission signal (first signal) from the amplifier circuit AMP is supplied to the input port IN. The transmission signal is supplied to the antenna ANT via the main line ML and the output port OUT. A reflected signal of the transmission signal is supplied to the output port OUT. The sub-line SL (first sub-line) is electromagnetically coupled to the main line ML. One end of the sub-line SL, which corresponds to the one end of the main line ML, is connected to the switch SW1, and another end of the sub-line SL, which corresponds to the other end of the main line ML, is connected to the switch SW2.

The detection port DET is connected to the switches SW1 and SW2. A detection signal of the transmission signal or a detection signal of the reflected signal of the transmission signal is outputted from the detection port DET.

The switch SW1 electrically connects the one end of the sub-line SL to the detection port DET or the termination circuit Z1 in accordance with a control signal supplied from the outside. The switch SW2 electrically connects the other end of the sub-line SL to the detection port DET or the termination circuit Z2 in accordance with a control signal supplied from the outside. Specifically, when the bidirectional coupler 100A is in an operation mode (first mode) for detecting the transmission signal, the switch SW1 is switched to the detection port DET side, and the switch SW2 is switched to the termination circuit Z2 side. When the bidirectional coupler 100A is in an operation mode (second mode) for detecting the reflected signal of the transmission signal, the switch SW1 is switched to the termination circuit Z1 side, and the switch SW2 is switched to the detection port DET side. The switch SW1 and the switch SW2 constitute a specific example of a switch circuit.

The termination circuit Z1 includes, for example, a resistance element Rf and a capacitance element Cf, which are connected in parallel with each other, and the termination circuit Z2 includes, for example, a resistance element Rr and a capacitance element Cr, which are connected in parallel with each other. Specifically, each of the resistance element Rf and the capacitance element Cf has one end connected to the switch SW1 and another end grounded. Likewise, each of the resistance element Rr and the capacitance element Cr has one end connected to the switch SW2 and another end grounded. Each of the termination circuits Z1 and Z2 connects the one end or the other end of the sub-line SL to ground. In the bidirectional coupler 100A, the magnetic-field coupled component and the electric-field coupled component of the current flowing through the resistance elements Rf and Rr are not equal, and isolation may deteriorate. The capacitance elements Cf and Cr function such that the contribution to the electric-field coupling and the contribution to the magnetic-field coupling become equal. This makes it possible to improve the isolation and directivity of the bidirectional coupler 100A. Directivity is a measure (dB) expressed as a value obtained by subtracting the degree of coupling from the isolation.

The one end of the capacitance element Cf may be connected between the one end of the sub-line SL and the switch SW1, and the one end of the capacitance element Cr may be connected between the other end of the sub-line SL and the switch SW2. In addition, the bidirectional coupler 100A may not necessarily include the capacitance elements Cf and Cr.

The matching network MN is disposed between the switches SW1 and SW2 and the detection port DET. The matching network MN converts the impedance on the detection port DET side seen from the outside of the bidirectional coupler 100A to suppress the return loss at the detection port DET. The following describes the details of the configuration of the matching network MN.

Figure 2:
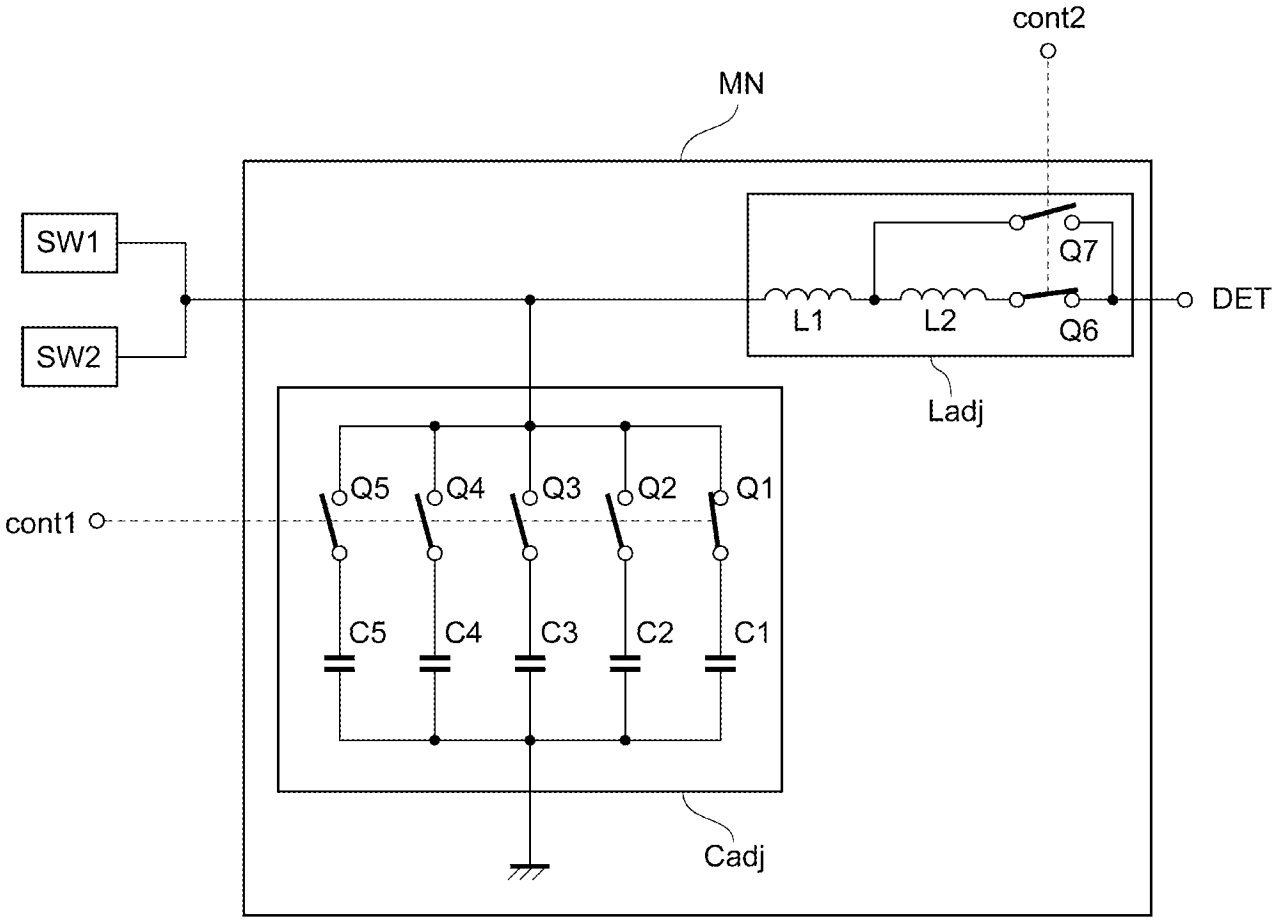
FIG. 2 is a diagram illustrating an example configuration of a matching network MN.

FIG. 2 is a diagram illustrating an example configuration of the matching network MN. The matching network MN includes, for example, a variable capacitor Cadj and a variable inductor Ladj. The variable capacitor Cadj is shunt-connected to a signal line between the switches SW1 and SW2 and the detection port DET, and the variable inductor Ladj is connected in series with the signal line between the switches SW1 and SW2 and the detection port DET. That is, the variable capacitor Cadj and the variable inductor Ladj constitute an LC circuit.

The variable capacitor Cadj (first variable capacitor) includes, for example, capacitance elements C1 to C5 and switches Q1 to Q5. The capacitance elements C1 to C5 are connected in parallel with each other. Each of the capacitance elements C1 to C5 has one end connected to the switches SW1 and SW2 through the corresponding one of the switches Q1 to Q5 and another end grounded. The turning on and off of the switches Q1 to Q5 are controlled in accordance with a control signal cont1 supplied from a control circuit (not illustrated). Accordingly, an electrically connected combination of the capacitance elements C1 to C5 is changed, and the capacitance value of the variable capacitor Cadj is adjusted.

The variable inductor Ladj (first variable inductor) includes, for example, inductance elements L1 and L2 and switches Q6 and Q7. The inductance element L1 and the inductance element L2 are connected in series with each other. Each of the inductance element L1 and the inductance element L2 has one end connected to the switches SW1 and SW2 and another end connected to the detection port DET through the switch Q6. The switches Q6 and Q7 are controlled in accordance with a control signal cont2 supplied from the control circuit (not illustrated) such that one of the switches Q6 and Q7 is turned on and the other switch is turned off. Accordingly, the inductance value of the variable inductor Ladj is adjusted.

In the matching network MN, as described above, the capacitance value and the inductance value are adjusted in accordance with the control signals cont1 and cont2 supplied from the outside. Specifically, in the matching network MN, either or both of the capacitance value of the variable capacitor Cadj and the inductance value of the variable inductor Ladj are controlled in accordance with the operation mode (i.e., the direction of the signal to be detected) or the frequency band of the signal to be detected. Accordingly, the impedance on the detection port DET side seen from the outside of the bidirectional coupler 100A is converted into the desired value (e.g., about 50Ω), regardless of the direction and frequency band of the signal to be detected. Thus, an increase in return loss at the detection port DET can be suppressed.

The configurations of the variable capacitor Cadj and the variable inductor Ladj illustrated in FIG. 2 are illustrative but not restrictive. For example, in FIG. 2, the variable capacitor Cadj includes five capacitance elements C1 to C5 and is controlled by 5 bits, by way of example. However, the number of parallel-connected capacitance elements is not limited to this.

The matching network MN may further include a variable resistor (first variable resistor) in addition to the variable capacitor Cadj and the variable inductor Ladj illustrated in FIG. 2, or may include a variable resistor in place of the variable capacitor Cadj and the variable inductor Ladj. That is, it is only required for the matching network MN to include at least one of a variable capacitor, a variable inductor, or a variable resistor. The variable resistor may be used not only for impedance matching but also for the adjustment of the degree of coupling obtained by the main line ML and the sub-line SL.

Figure 3:
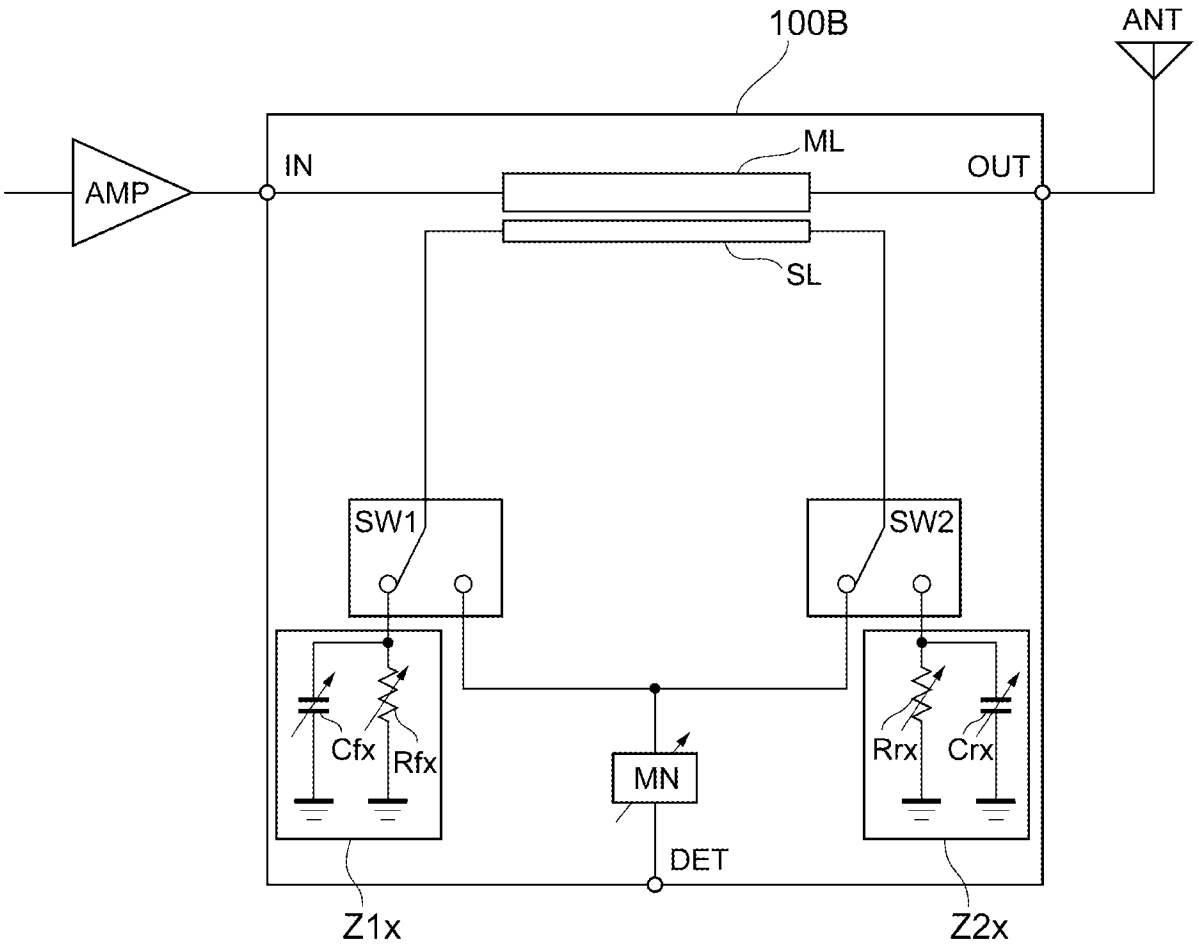
FIG. 3 is a diagram illustrating the configuration of a bidirectional coupler 100B according to another embodiment of the present disclosure.

FIG. 3 is a diagram illustrating the configuration of a bidirectional coupler 100B according to another embodiment of the present disclosure. The same elements as those of the bidirectional coupler 100A are assigned with the same numerals and will not be described. Further, in the following embodiments, the features common to the bidirectional coupler 100A will not be described, and only different points will be described. In particular, similar operational effects achieved with similar configurations will not be described again in the individual embodiments.

As illustrated in FIG. 3, unlike the bidirectional coupler 100A, the bidirectional coupler 100B includes termination circuits Z1*x* (second termination circuit) and Z2*x* (first termination circuit) in place of the termination circuits Z1 and Z2. The termination circuits Z1*x* and Z2*x* are configured such that the resistance elements Rf and Rr and the capacitance elements Cf and Cr of the termination circuits Z1 and Z2 are replaced with variable resistors Rfx (fourth variable resistor) and Rrx (third variable resistor) and variable capacitors Cfx (fourth variable capacitor) and Crx (third variable capacitor), respectively.

Specifically, each of the variable resistor Rfx and the variable capacitor Cfx has one end connected to the switch SW1 and another end grounded. Likewise, each of the variable resistor Rrx and the variable capacitor Crx has one end connected to the switch SW2 and another end grounded.

Figure 4:
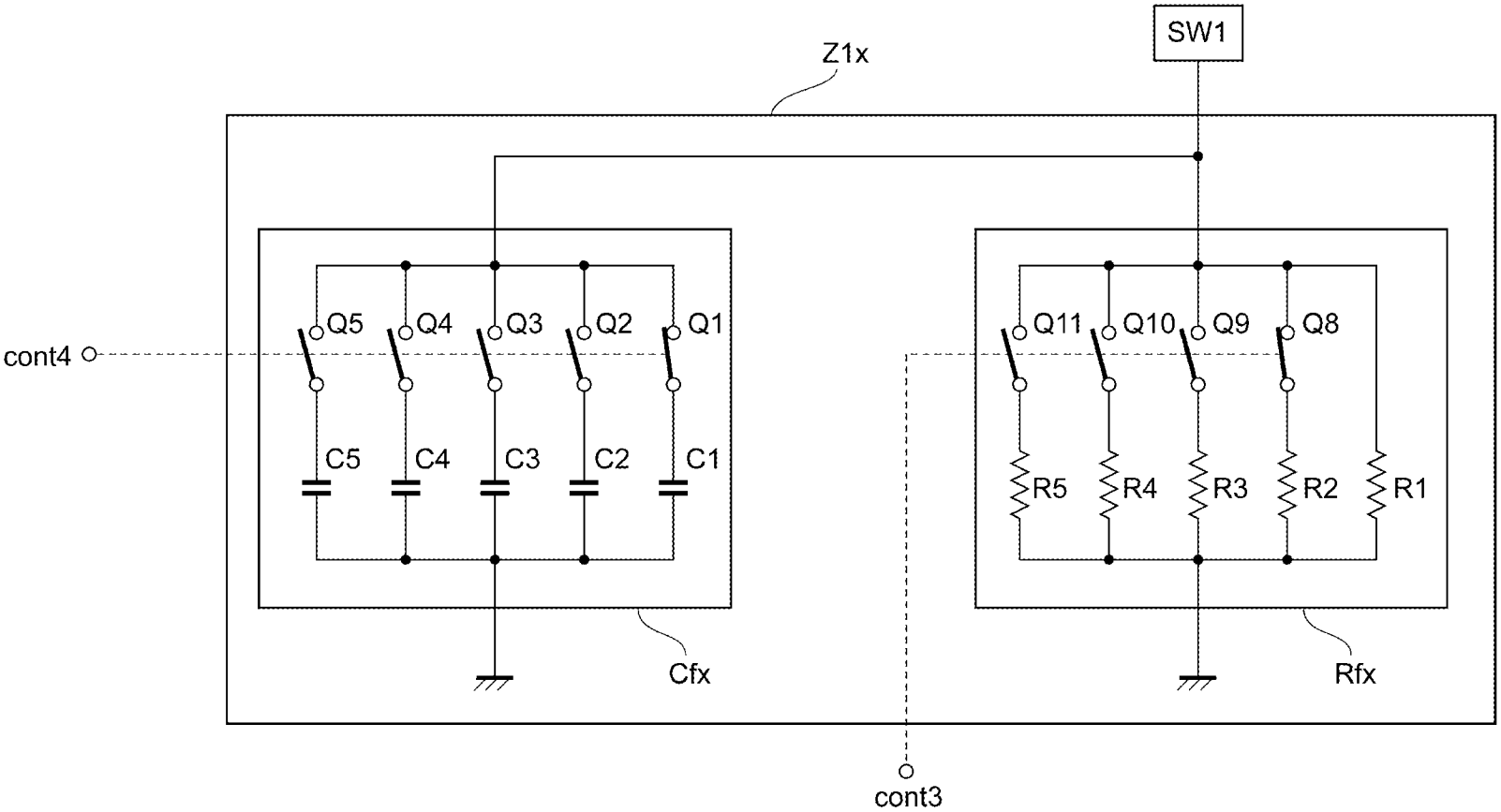
FIG. 4 is a diagram illustrating an example configuration of a termination circuit Z1*x*.

FIG. 4 is a diagram illustrating an example configuration of the termination circuit Z1*x*. The termination circuit Z2*x* is similar to the termination circuit Z1*x* and thus will not be described in detail.

The variable resistor Rfx includes, for example, resistance elements R1 to R5 and switches Q8 to Q11. The resistance elements R1 to R5 are connected in parallel with each other. The resistance element R1 has one end connected to the switch SW1 and another end grounded. Each of the resistance elements R2 to R5 is connected to the switch SW1 through the corresponding one of the switches Q8 to Q11 and another end grounded. The turning on and off of the switches Q8 to Q11 are controlled in accordance with a control signal cont3 supplied from a control circuit (not illustrated). Accordingly, an electrically connected combination of the resistance elements R1 to R5 is changed, and the resistance value of the variable resistor Rfx is adjusted. The configuration of the variable capacitor Cfx is similar to the configuration of the variable capacitor Cadj illustrated in FIG. 2, and thus will not be described in detail.

In the termination circuit Z1*x*, as described above, the resistance value and the capacitance value are adjusted in accordance with the control signals cont3 and cont4 supplied from the outside. Specifically, in the termination circuits Z1*x* and Z2*x*, either or both of the resistance value of the variable resistors Rfx and Rrx and the capacitance value of the variable capacitors Cfx and Crx are controlled in accordance with the operation mode (i.e., the direction of the signal to be detected) or the frequency band of the signal to be detected. Accordingly, the directivity and isolation of the bidirectional coupler 100B can be improved, regardless of the direction and frequency band of the signal to be detected. In the bidirectional coupler 100B, furthermore, the capacitance value, the inductance value, and the resistance value of the matching network MN can be adjusted in accordance with the adjustment of the resistance values and the capacitance values of the termination circuits Z1*x* and Z2*x*. Accordingly, an increase in return loss at the detection port DET can be suppressed with the improved directivity and isolation.

FIG. 3 illustrates an example in which both the resistance elements Rf and Rr and both the capacitance elements Cf and Cr of the termination circuits Z1 and Z2 illustrated in FIG. 1 are replaced with variable resistors and variable capacitors, respectively. Alternatively, some of the elements may be replaced with a variable resistor or a variable capacitor. In addition, the termination circuits Z1*x* and Z2*x* may not necessarily include the variable capacitors Cfx and Crx.

Figure 5:
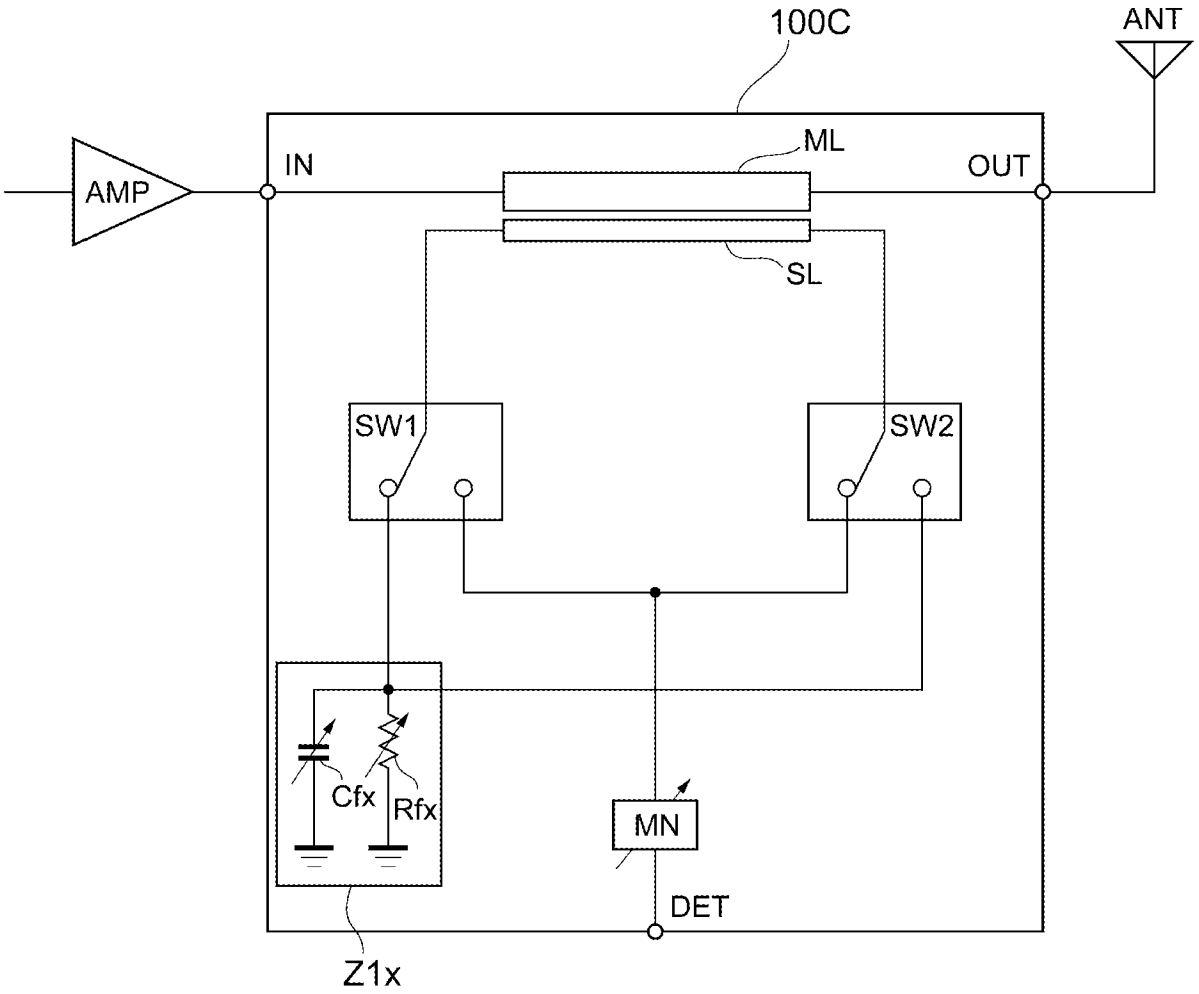
FIG. 5 is a diagram illustrating the configuration of a bidirectional coupler 100C according to another embodiment of the present disclosure.

FIG. 5 is a diagram illustrating the configuration of a bidirectional coupler 100C according to another embodiment of the present disclosure. The same elements as those of the bidirectional coupler 100B are assigned with the same numerals and will not be described. As illustrated in FIG. 5, in the bidirectional coupler 100C, unlike the bidirectional coupler 100B, a single termination circuit Z1*x* serves as a termination circuit in both the forward and reverse operation modes.

Specifically, one end of the variable resistor Rfx (second variable resistor) and one end of the variable capacitor Cfx (second variable capacitor) are connected to the switch SW2 in the forward operation mode, and are connected to the switch SW1 in the reverse operation mode. Accordingly, the termination circuit Z1*x* is shared as a termination circuit for the sub-line SL in both the forward and reverse operation modes.

With this configuration, like the bidirectional coupler 100B, the bidirectional coupler 100C can also suppress an increase in return loss at the detection port DET while improving directivity and isolation. In the bidirectional coupler 100C, furthermore, the number of termination circuits can be smaller than that in the bidirectional coupler 100B, achieving a reduction in circuit scale.

The termination circuit Z1*x* may not necessarily include the variable capacitor Cfx.

Figure 6:
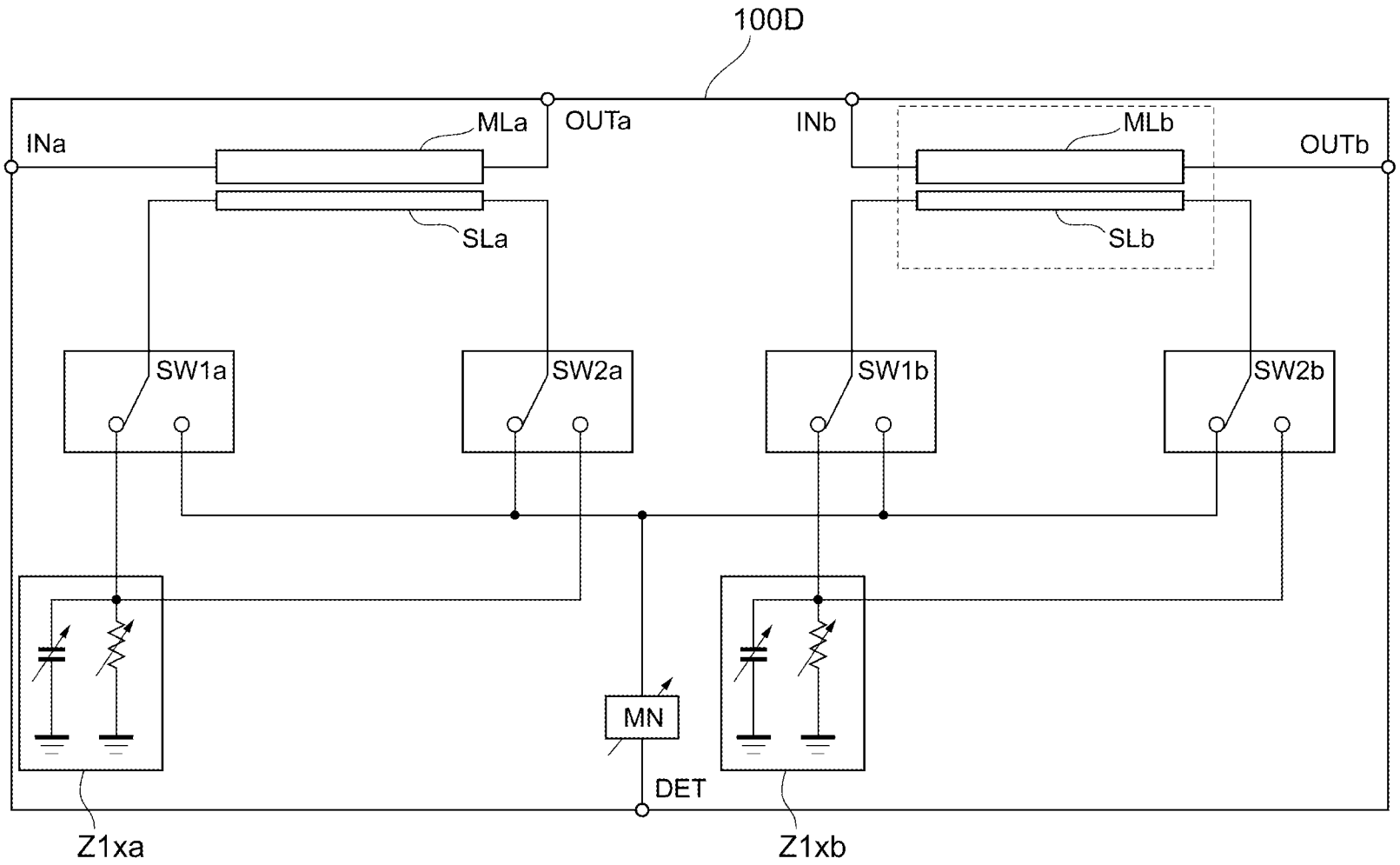
FIG. 6 is a diagram illustrating the configuration of a bidirectional coupler 100D according to another embodiment of the present disclosure.
Figure 7:
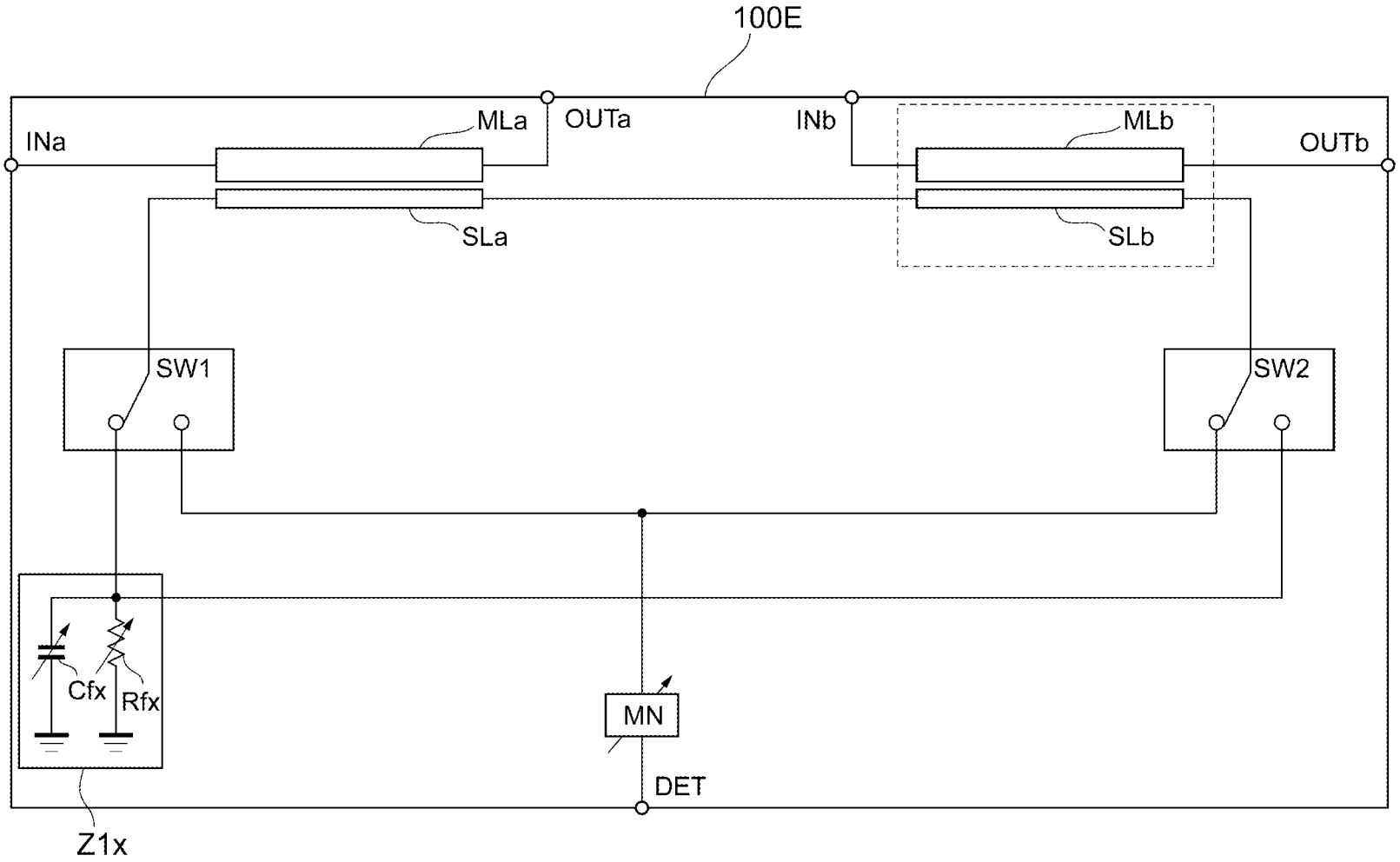
FIG. 7 is a diagram illustrating the configuration of a bidirectional coupler 100E according to another embodiment of the present disclosure.

FIG. 6 is a diagram illustrating the configuration of a bidirectional coupler 100D according to another embodiment of the present disclosure. The same elements as those of the bidirectional coupler 100C are assigned with the same numerals and will not be described. In FIG. 6 and FIG. 7 described below, the amplifier circuit AMP and the antenna ANT are not illustrated.

As illustrated in FIG. 6, the bidirectional coupler 100D includes two configurations of the bidirectional coupler 100C, each configuration being illustrated in FIG. 5, thereby being capable of detecting two types of transmission signals or the respective reflected signals of the two types of transmission signals. Specifically, the bidirectional coupler 100D includes two input ports (INa, INb), two output ports (OUTa, OUTb), two main lines (MLa, MLb), two sub-lines (SLa, SLb), two switches (SW1*a*, SW1*b*), two switches (SW2*a*, SW2*b*), and two termination circuits (Z1*xa*, Z1*xb*).

The main line MLb (second main line) has one end connected to the input port INb (third port) and another end connected to the output port OUTb (fourth port). A transmission signal (second signal) having a frequency band different from, for example, the frequency band of the signal inputted to the input port INa is supplied to the input port INb. The transmission signal is supplied to an antenna (not illustrated) through the main line MLb and the output port OUTb. A reflected signal of the transmission signal is supplied to the output port OUTb. The sub-line SLb (second sub-line) is electromagnetically coupled to the main line MLb. One end of the sub-line SLb, which corresponds to the one end of the main line MLb, is connected to the switch SW1*b*, and another end of the sub-line SLb, which corresponds to the other end of the main line MLb, is connected to the switch SW2*b*. The switches SW1*b* and SW2*b* respectively electrically connect the one end and the other end of the sub-line SLb to the detection port DET or the termination circuit Z1*xb* (second termination circuit). The switch SW1*a* and the switch SW2*a* constitute a specific example of a first switch circuit, and the switch SW1*b* and the switch SW2*b* constitute a specific example of a second switch circuit. The operations of the switches SW1*a* and SW2*a* and the switches SW1*b* and SW2*b* are similar to those of the switches SW1 and SW2 in the bidirectional coupler 100C, and thus will not be described in detail.

With the configuration described above, the bidirectional coupler 100D can switch between two types of transmission signals or the respective reflected signals of the two types of transmission signals for detection. Specifically, the bidirectional coupler 100D has, in addition to an operation mode (first mode) for detecting a transmission signal traveling through the main line MLa and an operation mode (second mode) for detecting a reflected signal of the transmission signal, an operation mode (third mode) for detecting a transmission signal traveling through the main line MLb and an operation mode (fourth mode) for detecting a reflected signal of the transmission signal. The matching network MN and the detection port DET are shared in the four operation modes.

In the bidirectional coupler 100D, the transmission signal traveling through the main line MLa and the reflected signal, and the transmission signal traveling through the main line MLb and the reflected signal are outputted from the common detection port DET via the matching network MN. Thus, with this configuration, the bidirectional coupler 100D can also suppress an increase in return loss at the detection port DET while improving the directivity and isolation of transmission signals having different frequency bands.

In the bidirectional coupler 100D, for example, the main line MLa, the sub-line SLa, the switches SW1*a*, SW2*a*, SW1*b*, and SW2*b*, the termination circuits Z1*xa* (first termination circuit) and Z1*xb* (second termination circuit), and the matching network MN may be formed on an integrated circuit, and the main line MLb and the sub-line SLb (i.e., a broken-line portion illustrated in FIG. 6) may be formed on a substrate having the integrated circuit mounted thereon.

FIG. 7 is a diagram illustrating the configuration of a bidirectional coupler 100E according to another embodiment of the present disclosure. The same elements as those of the bidirectional coupler 100D are assigned with the same numerals and will not be described.

As illustrated in FIG. 7, in the bidirectional coupler 100E, unlike the bidirectional coupler 100D illustrated in FIG. 6, the switches SW1 and SW2 are shared for both the sub-line SLa and the sub-line SLb.

Specifically, the sub-line SLb is connected in series with the sub-line SLa. That is, the one end of the sub-line SLb, which corresponds to the one end of the main line MLb, is connected to the other end of the sub-line SLa, and the other end of the sub-line SLb, which corresponds to the other end of the main line MLb, is connected to the switch SW2. When the bidirectional coupler 100E is in an operation mode (third mode) for detecting the transmission signal traveling through the main line MLb, the switch SW1 is switched to the detection port DET side, and the switch SW2 is switched to the termination circuit Z1*x* side. Accordingly, the one end of the sub-line SLb is electrically connected to the detection port DET through the sub-line SLa, and the other end of the sub-line SLb is electrically connected to the termination circuit Z1*x*. When the bidirectional coupler 100D is in an operation mode (fourth mode) for detecting the reflected signal of the transmission signal traveling through the main line MLb, the switch SW1 is switched to the termination circuit Z1*x* side, and the switch SW2 is switched to the detection port DET side. Accordingly, the one end of the sub-line SLb is electrically connected to the termination circuit Z1*x* through the sub-line SLa, and the other end of the sub-line SLb is electrically connected to the detection port DET.

With this configuration, like the bidirectional coupler 100D, the bidirectional coupler 100E can also suppress the deterioration of the return loss at the detection port DET while improving directivity and isolation even when detecting transmission signals of a plurality of frequency bands. In the bidirectional coupler 100E, furthermore, the number of termination circuits and the number of switches can be smaller than those in the bidirectional coupler 100D, achieving a reduction in circuit scale.

In the bidirectional coupler 100E, for example, the main line MLa, the sub-line SLa, the switches SW1 and SW2, the termination circuit Z1*x*, and the matching network MN may be formed on an integrated circuit, and the main line MLb and the sub-line SLb (i.e., a broken-line portion illustrated in FIG. 7) may be formed on a substrate having the integrated circuit mounted thereon.

FIG. 6 and FIG. 7 illustrate configurations in which the bidirectional couplers 100D and 100E include two combinations of a main line and a sub-line. Alternatively, each bidirectional coupler may include three or more combinations of a main line and a sub-line.

Figure 8A:
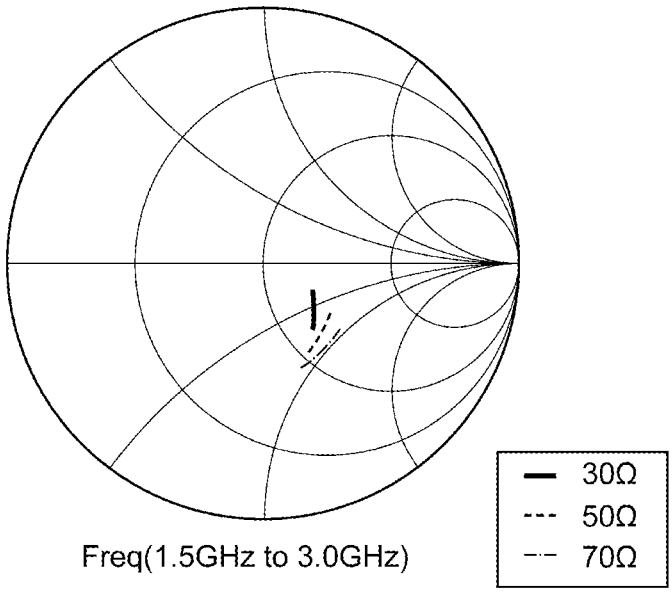
FIG. 8A is an explanatory diagram illustrating the loci of impedances at a detection port DET in a comparative example.
Figure 8B:
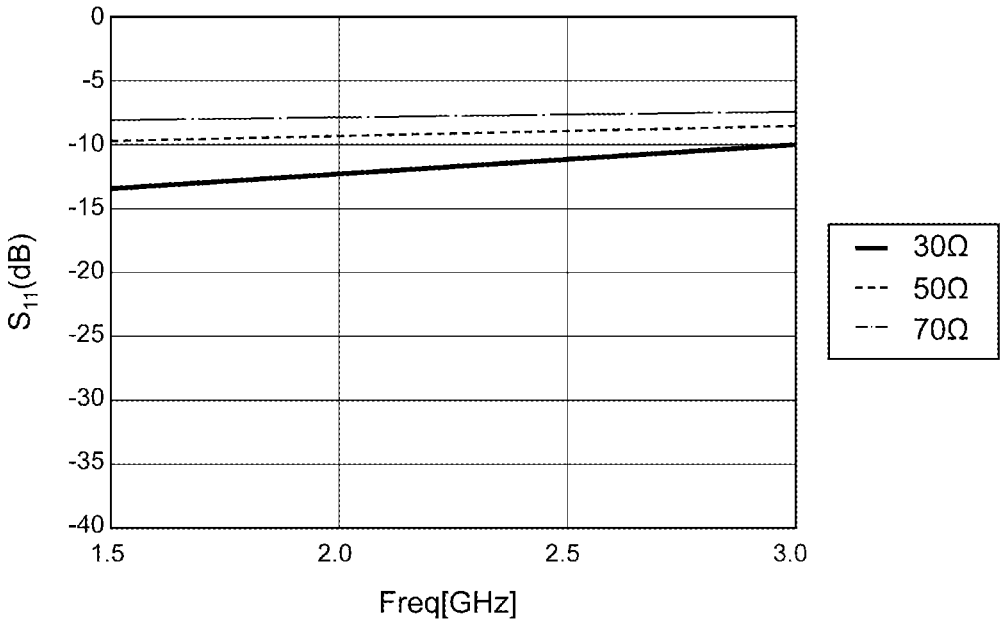
FIG. 8B is a diagram illustrating the simulation results of the reflection characteristic at the detection port DET in the comparative example.
Figure 9A:
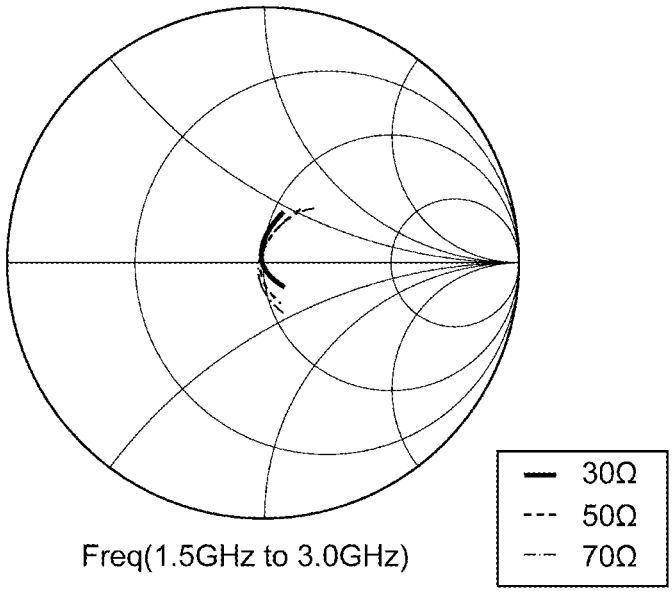
FIG. 9A is an explanatory diagram illustrating the loci of impedances at a detection port DET of the bidirectional coupler 100B.
Figure 9B:
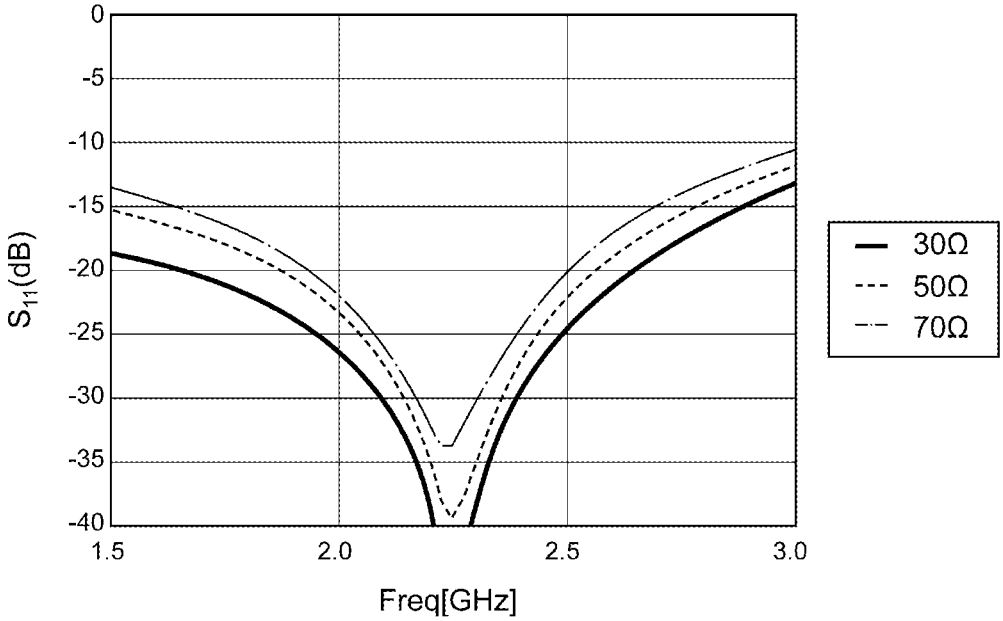
FIG. 9B is a diagram illustrating the simulation results of the reflection characteristic at the detection port DET of the bidirectional coupler 100B.

Next, the advantageous effects of an embodiment of the present disclosure will be described with reference to FIGS. 8A to 9B. FIG. 8A is an explanatory diagram illustrating the loci of impedances at the detection port DET in a comparative example, and FIG. 8B is a diagram illustrating the simulation results of the reflection characteristic at the detection port DET in the comparative example. FIG. 9A is an explanatory diagram illustrating the loci of impedances at the detection port DET of the bidirectional coupler 100B, and FIG. 9B is a diagram illustrating the simulation results of the reflection characteristic at the detection port DET of the bidirectional coupler 100B. The comparative example provides a configuration of the bidirectional coupler 100B from which the matching network MN is removed.

FIGS. 8A and 9A illustrate the loci of the impedances on the detection port DET side seen from the outside of the bidirectional coupler in an operation mode for detecting a reflected signal of a transmission signal when the frequency of the signal is changed from 1.5 GHz to 3.0 GHz. In FIGS. 8B and 9B, the horizontal axis represents frequency (GHz) and the vertical axis represents reflection characteristic (dB) at the detection port DET (i.e., S-parameter $S_{11}$ for the detection port DET). The values of the variable resistor Rfx and the variable capacitor Cfx of the termination circuit Z1*x* and the variable capacitor Cadj and the variable inductor Ladj of the matching network MN are adjusted in accordance with Table 1 below.

TABLE 1

| | Termination Circuit Z1x | | Matching Network MN | |
|---|---|---|---|---|
| | Variable Resistor Rfx (Ω) | Variable Capacitor Cfx (pF) | Variable Capacitor Cadj (pF) | Variable Inductor Ladj (nH) |
| Comparative Example | 30 | 0.15 | — | — |
| | 50 | 0.15 | — | — |
| | 70 | 0.15 | — | — |
| Bidirectional Coupler 100B | 30 | 0.15 | 1.1 | 3.8 |
| | 50 | 0.15 | 0.9 | 4.2 |
| | 70 | 0.15 | 0.8 | 4.5 |

First, in the comparative example, as illustrated in FIG. 8A, the impedances on the detection port DET side seen from the outside of the bidirectional coupler are far from the center of the Smith chart, regardless of the resistance value of the variable resistor Rfx. That is, the impedances of the stages before and after the detection port DET are found not to be matched. At this time, as illustrated in FIG. 8B, reflected waves at the detection port DET are about −14 dB to −7 dB, regardless of the frequency, and return loss is found to have occurred.

In the bidirectional coupler 100B, as illustrated in FIG. 9A, in contrast, the impedances on the detection port DET side seen from the outside of the bidirectional coupler are close to about the center of the Smith chart, regardless of the resistance value of the variable resistor Rfx. That is, in the bidirectional coupler 100B, with the adjustment of the capacitance value of the variable capacitor Cadj and the inductance value of the variable inductor Ladj of the matching network MN, the impedances of the stages before and after the detection port DET are found to be matched. At this time, as illustrated in FIG. 9B, reflected waves are kept less than or equal to about −30 dB at the desired frequency (in FIG. 9B, at about 2.25 GHz between 1.5 GHz and 3.0 GHz), and return loss is found to be improved, compared to that in the comparative example. As described above, in the bidirectional coupler 100B, the capacitance value and the inductance value of the matching network MN are adjusted in accordance with the impedance of the termination circuit Z1*x*, thereby enabling the suppression of deterioration of the return loss at the detection port DET. The frequencies in this simulation are examples, and return loss at any desired frequency can be suppressed by adjusting the capacitance value and the inductance value of the matching network MN.

Next, the simulation results obtained for different frequency bands of transmission signals will be described with reference to Table 2. Table 2 shows the values of the components obtained when the impedances of the stages before and after the detection port DET of the bidirectional coupler 100B are matched in a case where the frequency band of a transmission signal is the low band (e.g., frequencies of 699 MHz to 960 MHz) or the high band (e.g., frequencies of 1710 MHz to 2690 MHz).

TABLE 2

| | Termination Circuit Z1x | | Matching Network MN | |
|---|---|---|---|---|
| | Variable Resistor Rfx (Ω) | Variable Capacitor Cfx (pF) | Variable Capacitor Cadj (pF) | Variable Inductor Ladj (nH) |
| Low Band | 30 | 0.8 | 1.4 | 4.5 |
| | 50 | 0.8 | 1.0 | 7.0 |
| | 70 | 0.8 | 0.7 | 9.0 |
| High Band | 30 | 0.15 | 1.1 | 3.8 |
| | 50 | 0.15 | 0.9 | 4.2 |
| | 70 | 0.15 | 0.8 | 4.5 |

The values of the components of the termination circuit Z1*x* and the matching network MN are controlled as shown in Table 2 in accordance with the frequency band of the transmission signal, thereby making it possible to match the impedances of the stages before and after the detection port DET. Specifically, for example, regardless of the resistance value of the variable resistor Rfx of the termination circuit Z1*x*, the inductance value of the variable inductor Ladj of the matching network MN is controlled such that the value (second value) for the high band (second frequency band) is smaller than the value (first value) for the low band (first frequency band). That is, it is found that an increase in return loss at the detection port DET is suppressed by controlling the values of the components of the termination circuit Z1*x* and the matching network MN for transmission signals of different frequency bands. The values of the components shown in Table 2 are examples, and the combinations of the values of the components for which the impedances of the stages before and after the detection port DET are matched are not limited to those.

Exemplary embodiments of the present disclosure have been described. In the bidirectional couplers 100A to 100E, at least one of the capacitance value of the variable capacitor Cadj, the inductance value of the variable inductor Ladj, or the resistance value of the variable resistor included in the matching network MN is controlled in accordance with the operation mode (i.e., the direction of the signal to be detected) or the frequency band. This allows the impedance on the detection port DET side seen from the outside of the bidirectional couplers 100A to 100E to be matched to the desired value, regardless of the direction and frequency band of the signal to be detected. Accordingly, an increase in return loss at the detection port DET can be suppressed.

In addition, the matching network MN may be configured such that, for example, but not limited to, the variable capacitor Cadj is shunt-connected to a signal line and the variable inductor Ladj is connected in series with the signal line.

In the matching network MN, furthermore, the inductance value of the variable inductor Ladj is controlled in accordance with the frequency band of the signal to be detected, so as to be controlled to a relatively small value, for example, when the frequency is relatively high. Accordingly, the impedances of the stages before and after the detection port DET are matched.

In the bidirectional couplers 100C to 100E, furthermore, the termination circuit Z1*x* (Z1*xa*, Z1*xb*) includes the variable resistor Rfx and the variable capacitor Cfx, which are connected in parallel with each other, and at least one of the resistance value of the variable resistor Rfx or the capacitance value of the variable capacitor Cfx is controlled in accordance with the direction or frequency band of the signal to be detected. This can improve directivity and isolation, regardless of the direction and frequency band of the signal to be detected. In addition, the termination circuit Z1*x* is shared in different operation modes, thereby achieving a reduction in circuit scale.

In the bidirectional coupler 100B, furthermore, each of the termination circuits Z1*x* and Z2*x* includes the variable resistor Rfx and the variable capacitor Cfx, or the variable resistor Rrx and the variable capacitor Crx, which are connected in parallel with each other, and at least one of the resistance value of the variable resistor Rfx or Rrx or the capacitance value of the variable capacitor Cfx or Crx is controlled in accordance with the direction or frequency band of the signal to be detected. This can improve directivity and isolation, regardless of the direction and frequency band of the signal to be detected.

In addition, the bidirectional coupler 100D includes two configurations of the bidirectional coupler 100C, each configuration being illustrated in FIG. 5, and a transmission signal traveling through the main line MLa and its reflected signal and a transmission signal traveling through the main line MLb and its reflected signal are outputted from the common detection port DET via the matching network MN. With this configuration, the bidirectional coupler 100D can suppress an increase in return loss at the detection port DET while improving directivity and isolation of transmission signals having different frequency bands.

In addition, the bidirectional coupler 100E includes two configurations each for a main line and a sub-line of the bidirectional coupler 100C illustrated in FIG. 5, and the sub-line SLa and the sub-line SLb are connected in series. With this configuration, a single switch circuit (the switch SW1 and the switch SW2) and the single termination circuit Z1*x* can detect two types of transmission signals and reflected signals. Accordingly, the bidirectional coupler 100E can reduce the circuit scale, compared to the bidirectional coupler 100D.

In addition, the bidirectional coupler 100D may be configured such that, for example, but not limited to, the main line MLa, the sub-line SLa, the switches SW1*a*, SW2*a*, SW1*b*, and SW2*b*, the termination circuits Z1*xa* and Z1*xb*, and the matching network MN are formed on an integrated circuit and the main line MLb and the sub-line SLb are formed on a substrate having the integrated circuit mounted thereon.

In addition, the bidirectional coupler 100E may be configured such that, for example, but not limited to, the main line MLa, the sub-line SLa, the switches SW1 and SW2, the termination circuit Z1*x*, and the matching network MN are formed on an integrated circuit and the main line MLb and the sub-line SLb are formed on a substrate having the integrated circuit mounted thereon.

The embodiments described above are intended to help easily understand the present disclosure, and are not to be used to construe the present disclosure in a limiting fashion. Various modifications/improvements can be made to the present disclosure without departing from the gist of the present disclosure, and equivalents thereof are also included in the present disclosure. That is, the embodiments may be appropriately modified in design by those skilled in the art, and such modifications also fall within the scope of the present disclosure so long as the modifications include features of the present disclosure. For example, the elements included in the embodiments and the arrangement, materials, conditions, shapes, sizes, and the like thereof are not limited to those described in the illustrated examples, but can be modified as appropriate. Furthermore, the elements included in the embodiments can be combined as much as technically possible, and such combinations of elements also fall within the scope of the present disclosure so long as the combinations of elements include features of the present disclosure.

100A to 100E bidirectional coupler
AMP amplifier circuit
ANT antenna
IN input port
OUT output port
DET detection port
ML main line
SL sub-line
SW1, SW2, Q1 to Q11 switch
MN matching network
Z1, Z2, Z1*x*, Z2*x* termination circuit
Rf, Rr, R1 to R5 resistance element
Cf, Cr, C1 to C5 capacitance element
Cadj, Cfx, Crx variable capacitor
Ladj variable inductor
L1, L2 inductance element
Rfx, Rrx variable resistor

The invention claimed is:

1. A bidirectional coupler comprising:

a first port to which a first signal is inputted;

a second port from which the first signal is outputted;

a detection port from which a detection signal of the first signal or a detection signal of a reflected signal of the first signal is outputted;

a first main line having one end connected to the first port and another end connected to the second port;

a first sub-line electromagnetically coupled to the first main line, the first sub-line having one end corresponding to the one end of the first main line and another end corresponding to the other end of the first main line;

at least one termination circuit that connects the one end or the other end of the first sub-line to ground;

a switch circuit that connects each of the one end and the other end of the first sub-line to the detection port or the at least one termination circuit; and a matching network disposed between the switch circuit and the detection port, the matching network including at least one of a first variable capacitor, a first variable inductor, or a first variable resistor.

2. The bidirectional coupler according to claim 1, wherein when an operation mode is a first mode for detecting the first signal, the switch circuit electrically connects the one end of the first sub-line to the detection port, and electrically connects the other end of the first sub-line to the at least one termination circuit, when the operation mode is a second mode for detecting the reflected signal of the first signal, the switch circuit electrically connects the one end of the first sub-line to the at least one termination circuit, and electrically connects the other end of the first sub-line to the detection port, and at least one of a capacitance value of the first variable capacitor, an inductance value of the first variable inductor, or a resistance value of the first variable resistor is controlled in accordance with the operation mode or a frequency band of the first signal.

3. The directional coupler according to claim 1, wherein the first variable capacitor is shunt-connected to a signal line between the switch circuit and the detection port, and the first variable inductor is connected in series with the signal line between the switch circuit and the detection port.

4. The directional coupler according to claim 1, wherein an inductance value of the first variable inductor is controlled to a first value when the first signal has a first frequency band and to a second value smaller than the first value when the first signal has a second frequency band higher in frequency than the first frequency band.

5. The directional coupler according to claim 2, wherein the first variable capacitor is shunt-connected to a signal line between the switch circuit and the detection port, and the first variable inductor is connected in series with the signal line between the switch circuit and the detection port.

6. The directional coupler according to claim 2, wherein an inductance value of the first variable inductor is controlled to a first value when the first signal has a first frequency band and to a second value smaller than the first value when the first signal has a second frequency band higher in frequency than the first frequency band.

7. The directional coupler according to claim 2, wherein the at least one termination circuit includes a second variable capacitor and a second variable resistor connected in parallel with each other, and at least one of a capacitance value of the second variable capacitor or a resistance value of the second variable resistor is controlled in accordance with the operation mode or the frequency band of the first signal.

8. The directional coupler according to claim 2, wherein the at least one termination circuit includes a first termination circuit that connects the other end of the first sub-line to ground when the operation mode is the first mode, and a second termination circuit that connects the one end of the first sub-line to ground when the operation mode is the second mode, the first termination circuit includes a third variable capacitor and a third variable resistor connected in parallel with each other, the second termination circuit includes a fourth variable capacitor and a fourth variable resistor connected in parallel with each other, and at least one of a capacitance value of the third or fourth variable capacitor or a resistance value of the third or fourth variable resistor is controlled in accordance with the operation mode or the frequency band of the first signal.

9. A bidirectional coupler comprising:

a first port to which a first signal is inputted;

a second port from which the first signal is outputted;

a third port to which a second signal is inputted;

a fourth port from which the second signal is outputted;

a detection port from which any one of a detection signal of the first signal, a detection signal of a reflected signal of the first signal, a detection signal of the second signal, or a detection signal of a reflected signal of the second signal is outputted;

a first main line having one end connected to the first port and another end connected to the second port;

a second main line having one end connected to the third port and another end connected to the fourth port;

a first sub-line electromagnetically coupled to the first main line, the first sub-line having one end corresponding to the one end of the first main line and another end corresponding to the other end of the first main line;

a second sub-line electromagnetically coupled to the second main line, the second sub-line having one end corresponding to the one end of the second main line and another end corresponding to the other end of the second main line;

a first termination circuit that connects the one end or the other end of the first sub-line to ground;

a second termination circuit that connects the one end or the other end of the second sub-line to ground;

a first switch circuit that connects each of the one end and the other end of the first sub-line to the detection port or the first termination circuit;

a second switch circuit that connects each of the one end and the other end of the second sub-line to the detection port or the second termination circuit; and a matching network disposed between the first and second switch circuits and the detection port, the matching network including at least one of a first variable capacitor, a first variable inductor, or a first variable resistor.

10. The directional coupler according to claim 9, wherein when an operation mode is a first mode for detecting the first signal, the first switch circuit electrically connects the one end of the first sub-line to the detection port, and electrically connects the other end of the first sub-line to the first termination circuit, when the operation mode is a second mode for detecting the reflected signal of the first signal, the first switch circuit electrically connects the one end of the first sub-line to the first termination circuit, and electrically connects the other end of the first sub-line to the detection port, when the operation mode is a third mode for detecting the second signal, the second switch circuit electrically connects the one end of the second sub-line to the detection port, and electrically connects the other end of the second sub-line to the second termination circuit, when the operation mode is a fourth mode for detecting the reflected signal of the second signal, the second switch circuit electrically connects the one end of the second sub-line to the second termination circuit, and electrically connects the other end of the second sub-line to the detection port, and at least one of a capacitance value of the first variable capacitor, an inductance value of the first variable inductor, or a resistance value of the first variable resistor is controlled in accordance with the operation mode, a frequency band of the first signal, or a frequency band of the second signal.

11. The directional coupler according to claim 9, wherein the first variable capacitor is shunt-connected to a signal line between the first and second switch circuits and the detection port, and the first variable inductor is connected in series with the signal line between the first and second switch circuits and the detection port.

12. The directional coupler according to claim 9, wherein an inductance value of the first variable inductor is controlled to a first value when the first or second signal has a first frequency band and to a second value smaller than the first value when the first or second signal has a second frequency band higher in frequency than the first frequency band.

13. The directional coupler according to claim 9, wherein the first main line, the first sub-line, the first and second switch circuits, the first and second termination circuits, and the matching network are provided on an integrated circuit, and the second main line and the second sub-line are provided on a substrate having the integrated circuit mounted thereon.

14. The directional coupler according to claim 10, wherein the first termination circuit includes a second variable capacitor and a second variable resistor connected in parallel with each other, the second termination circuit includes a third variable capacitor and a third variable resistor connected in parallel with each other, and at least one of a capacitance value of the second or third variable capacitor or a resistance value of the second or third variable resistor is controlled in accordance with the operation mode, the frequency band of the first signal, or the frequency band of the second signal.

15. A bidirectional coupler comprising:

a first port to which a first signal is inputted;

a second port from which the first signal is outputted;

a third port to which a second signal is inputted;

a fourth port from which the second signal is outputted;

a detection port from which any one of a detection signal of the first signal, a detection signal of a reflected signal of the first signal, a detection signal of the second signal, or a detection signal of a reflected signal of the second signal is outputted;

a first main line having one end connected to the first port and another end connected to the second port;

a second main line having one end connected to the third port and another end connected to the fourth port;

a first sub-line electromagnetically coupled to the first main line, the first sub-line having one end corresponding to the one end of the first main line and another end corresponding to the other end of the first main line;

a second sub-line electromagnetically coupled to the second main line, the second sub-line having one end corresponding to the one end of the second main line and another end corresponding to the other end of the second main line, the second sub-line being connected in series with the first sub-line;

a termination circuit that connects the one end or the other end of the first sub-line or the one end or the other end of the second sub-line to ground;

a switch circuit that connects each of the one end of the first sub-line, the other end of the first sub-line, the one end of the second sub-line, and the other end of the second sub-line to the detection port or the termination circuit; and a matching network disposed between the switch circuit and the detection port, the matching network including at least one of a first variable capacitor, a first variable inductor, or a first variable resistor.

16. The directional coupler according to claim 15, wherein the first variable capacitor is shunt-connected to a signal line between the switch circuit and the detection port, and the first variable inductor is connected in series with the signal line between the switch circuit and the detection port.

17. The directional coupler according to claim 15, wherein an inductance value of the first variable inductor is controlled to a first value when the first or second signal has a first frequency band and to a second value smaller than the first value when the first or second signal has a second frequency band higher in frequency than the first frequency band.

18. The directional coupler according to claim 15, wherein the termination circuit includes a second variable capacitor and a second variable resistor connected in parallel with each other, and at least one of a capacitance value of the second variable capacitor or a resistance value of the second variable resistor is controlled in accordance with the operation mode, a frequency band of the first signal, or a frequency band of the second signal.

19. The directional coupler according to claim 15, wherein when an operation mode is a first mode for detecting the first signal, the switch circuit electrically connects the one end of the first sub-line to the detection port, and electrically connects the other end of the first sub-line to the termination circuit through the second sub-line, when the operation mode is a second mode for detecting the reflected signal of the first signal, the switch circuit electrically connects the one end of the first sub-line to the termination circuit, and electrically connects the other end of the first sub-line to the detection port through the second sub-line, when the operation mode is a third mode for detecting the second signal, the switch circuit electrically connects the one end of the second sub-line to the detection port through the first sub-line, and electrically connects the other end of the second sub-line to the termination circuit, when the operation mode is a fourth mode for detecting the reflected signal of the second signal, the switch circuit electrically connects the one end of the second sub-line to the termination circuit through the first sub-line, and electrically connects the other end of the second sub-line to the detection port, and at least one of a capacitance value of the first variable capacitor, an inductance value of the first variable inductor, or a resistance value of the first variable resistor is controlled in accordance with the operation mode, a frequency band of the first signal, or a frequency band of the second signal.

20. The directional coupler according to claim 15, wherein the first main line, the first sub-line, the switch circuit, the termination circuit, and the matching network are provided on an integrated circuit, and the second main line and the second sub-line are provided on a substrate having the integrated circuit mounted thereon.

* * * * *